US005948178A

United States Patent [19]

Dolan et al.

[11] Patent Number: 5,948,178

[45] **Date of Patent: *Sep. 7, 1999**

[54] COMPOSITION AND PROCESS FOR FORMING A SOLID ADHERENT PROTECTIVE COATING ON METAL SURFACES

[75] Inventors: Shawn E. Dolan, Sterling Heights; Lawrence R. Carlson, Waterford; John R. Pierce, Huntington Woods, all of Mich.

[73] Assignee: Henkel Corporation, Gulph Mills, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/454,301

[22] PCT Filed: Jan. 13, 1995

[86] PCT No.: PCT/US95/00205

§ 371 Date: Jun. 16, 1995

§ 102(e) Date: Jun. 16, 1995

[87] PCT Pub. No.: WO96/21753

PCT Pub. Date: Jul. 18, 1996

[51] Int. Cl.[6] ..... C23C 22/48

[52] U.S. Cl. ..... 148/273; 148/274; 148/275; 148/277; 148/285

[58] Field of Search ..... 148/273, 274, 148/275, 277, 285

[56] References Cited

U.S. PATENT DOCUMENTS

| | | | |
|---|---|---|---|
| 3,905,838 | 9/1975 | Ito | 148/6.27 |
| 4,963,596 | 10/1990 | Lindert et al. | 526/313 |
| 5,089,064 | 2/1992 | Reghi | 148/247 |
| 5,226,976 | 7/1993 | Carlson et al. | 148/257 |
| 5,268,042 | 12/1993 | Carlson | 148/268 |
| 5,281,282 | 1/1994 | Dolan et al. | 148/247 |
| 5,298,092 | 3/1994 | Schriever | 148/275 |
| 5,342,456 | 8/1994 | Dolan | 148/247 |
| 5,551,994 | 9/1996 | Schriever | 148/273 |

FOREIGN PATENT DOCUMENTS

| | | |
|---|---|---|
| 9400619 | 1/1994 | WIPO . |
| 9514539 | 6/1995 | WIPO . |

OTHER PUBLICATIONS

F.A. Cotton & G. Wilkinson, *Advanced Inorganic Chemistry,* 4th Ed., (John Wiley & Sons, New York, 1980), p. 712.

*Primary Examiner*—David A. Simmons
*Assistant Examiner*—Robert R. Koehler
*Attorney, Agent, or Firm*—Wayne C. Jaeschke; Norvell E. Wisdom, Jr.; Wayne C. Jaeschke, Jr.

[57] ABSTRACT

An aqueous liquid chromate free composition for forming a protective coating on metals, particularly aluminum, is made by reacting cobalt(II) cations, carboxylate anions, at least one other type of coordinate complexing agent for cobalt (III) cations, and an oxidizing agent in an aqueous solution in which the molar ratio of carboxylate anions to cobalt(II) cations is from 0.10 to 6.8 and the aqueous solution contains no more than 1% of each of ammonia, ammonium ions, and nitrite ions.

20 Claims, No Drawings

COMPOSITION AND PROCESS FOR FORMING A SOLID ADHERENT PROTECTIVE COATING ON METAL SURFACES

BACKGROUND OF THE INVENTION

1. Field of the Invention

This invention relates to compositions and processes for forming a protective coating on metal, particularly aluminum and/or aluminum alloy, surfaces. The coating formed is solid and adherent, often although not always colored, provides good corrosion protection to the metal surface, and functions as an excellent base for painting or similar organic based protective coatings. The coatings formed, when applied to substrates of aluminum and its alloys, usually impart as much corrosion protection as do conventional coatings formed by use of hexavalent chromium containing compositions, but the compositions and processes according to this invention cause less potential environmental dam-age because they do not need hexavalent chromium or other identified major pollutants.

1. Discussion of Related Art

The art believed to be most closely related is that described in WO94/00619, particularly Table II thereof This reference teaches that high quality coatings can be formed on metal substrates by contacting them with aqueous compositions believed to contain cobalt(III) complex anions formed by reaction among cobalt(II) salts, carboxylate ions, and various other ions in the presence of an oxidizing agent. Other closely related art includes U.S. Pat. No. 3,905,838 of Sep. 16, 1975 to Ito and U.S. Pat. No. 5,298,092 of Mar. 29, 1994 to Schriever.

Many of the compositions taught in this related art, although they have avoided the use of hexavalent chromium and other pollutants of the general environment, nevertheless can have adverse environmental impacts on the immediate working area for the process and any workers in this area. For example, many of the formulations previously used include high concentrations of ammonia, which causes at least a severe odor nuisance and possibly a serious health hazard to workers in the vicinity, unless expensive ventilation equipment is installed in the process area. Furthermore, the concentration of ammonia in aqueous solutions is difficult to maintain constant, as is desirable for achieving the most consistent results from the process, at the high levels previously recommended by some related art. In addition, some of the previously recommended compositions contain both nitrite ions and amines, which are generally believed to be readily capable of reacting to form nitrosamines, many of which are known carcinogens.

DESCRIPTION OF THE INVENTION

Objects of the Invention

One major object of the invention is to provide compositions and processes that have reduced adverse environmental impact compared with related previously recommended processes as described above. Another alternative object is to provide more economical compositions and processes than those previously recommended, in particular by at least one of the following means: (i) reducing the treatment time required to form an effective protective coating and (ii) lowering the concentrations of active ingredients. Still another alternative object is to provide coatings with higher corrosion resistance, as formed and/or after subsequent painting or the like.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes oligomer; the description of a group or class of materials as suitable or preferred for a given purpose in connection with the invention implies that mixtures of any two or more of the members of the group or class are equally suitable or preferred, description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the stated objects of the invention); and the term "mole" and its variations may be applied to elemental, ionic, and any other chemical species defined by number and type of atoms present, as well as to compounds with well defined molecules.

SUMMARY OF THE INVENTION

Compositions according to the invention are made by reaction in an aqueous solution comprising, preferably consisting essentially of, or more preferably consisting of, water and the following dissolved components:

(A) cobalt(II) cations;

(B) carboxylate anions;

(C) chemical species, exclusive of carboxylate anions, that form more stable coordination bonds with cobalt(III) cations than with cobalt(II) cations; and (D) an oxidizing agent; and, optionally, one or more of the following components:

(E) nitrate ions;

(F) a component selected from the group consisting of alkali metal and alkaline earth metal cations; and (G) fluoride and complex fluoride anions, wherein the ratio of the number of moles of component (B) to the number of moles of component (A) in the aqueous solution prior to reaction is from 0.10 to 6.8.

Various embodiments of the invention include working compositions for direct use in treating metals, concentrates from which such working compositions can be prepared by dilution with water and/or mixing with other concentrates, processes for treating metals with a composition according to the invention, and extended processes including additional steps that are conventional per se, such as precleaning, rinsing, and, particularly advantageously, painting or some similar overcoating process that puts into place a protective coating containing an organic binder over the conversion coating formed according to a narrower embodiment of the invention. Articles of manufacture including surfaces treated according to a process of the invention are also within the scope of the invention.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium, cyanide, nitrite ions, ammonia and ammonium cations, and any coordinate complexing agents that stabilize cobalt(II) more than cobalt(III) cations.

Furthermore, in a process according to the invention that includes other steps than the drying into place on the surface of the metal of a layer of a composition as described above, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium, except that a final protective coating system including an organic binder, more particularly those including primer coat, may include hexavalent chromium as a constituent. Any such hexavalent chromium in the protective coating is generally adequately confined by the organic binder, so as to avoid adverse environmental impact.

The concentration of component (A) reacted preferably is such that, in a working composition according to the invention, the concentration of cobalt atoms is, with increasing preference in the order given, not less than 0.001, 0.002, 0.004, 0.008, 0.016, 0.032, 0.040, 0.045, 0.050, 0.055, 0.060, 0.063, 0.066, 0.069, 0.072, 0.074, or 0.076 moles per liter (hereinafter usually abbreviated "M") and independently preferably is, with increasing preference in the order given, not more than 0.8, 0.6, 0.4, 0.2, 0.17, 0.14, 0.11, 0.090, 0.085, 0.080, or 0.078 M. The particular counterion (s) in the salt(s) in the form of which the cobalt cations are actually added to the aqueous solution in which they are reacted are not believed to be critical, except for avoiding any counterions that bind so stably to cobalt(II) that they prevent it from being oxidized to cobalt(III) during reaction with the other components. In order to minimize the prospects of unwanted interference with the desired reactions, the counterions for cobalt when added to the aqueous solution in which it is reacted are preferably selected from the group consisting of nitrate ions, which have relatively weak complex forming tendencies, and carboxylate ions that are part of component (B).

Component (B) is preferably selected from the anions of unsubstituted carboxylic acids containing from 1 to 6 carbon atoms, or more preferably, with increasing preference in the order given, not more than 5, 4, 3, or 2 carbon atoms, per molecule. Acetate ions are most preferred, largely because they are less expensive than most other carboxylates. Independently, the ratio of the number of moles of component (B) to the number of moles of component (A) in solution before any reaction between them preferably is, with increasing preference in the order given, at least 0.1, 0.2, 0.4, 0.8, 1.2, 1.5, 1.8, 2.0, 2.2, 2.3, 2.4, 2.5, or 2.6 and independently preferably is, with increasing preference in the order given, not greater than 6.5, 6.0, 5.5, 5.0, 4.5, 4.0, 3.7, 3.4, 3.1, 3.0, 2.9, 2.8, or 2.7. The most preferred concentrations of carboxylate ions are thus greater than can be supplied by cobalt(II) carboxylates themselves, and for the alternative cations that serve as counterions for this "excess" carboxylate, alkaline earth metal cations, particularly magnesium and calcium, most preferably magnesium, are preferred over alkali metal cations, although the latter can also be used. The use of carboxylic acids to supply the needed amounts of carboxylate ions, although also possible within the scope of the invention, is not preferred, because such use tends to depress the pH range below the most preferred values as set forth below.

Component (C) preferably is selected from organic compounds containing at least one nitrogen or phosphorus atom, more preferably nitrogen atom, with an unshared electron pair per molecule of compound. Hydroxyalkyl amines, most particularly triethanol amine and organic phosphines, are the most preferred class of materials for component (C). Independently, the ratio of molar concentration of the total of nitrogen and phosphorus atoms each bearing an unshared electron pair to the molar concentration of component (A) present in solution before any reaction between them preferably is, with increasing preference in the order given, not less than 0.03, 0.06, 0.13, 0.20, 0.24, 0.26, 0.28, 0.30, 0.32, 0.34, 0.35, or 0.36 and independently preferably is, with increasing preference in the order given, not more than 2.0, 1.75, 1.50, 1.25, 1.00, 0.75, 0.60, 0.50, 0.45, 0.41, 0.39, or 0.38.

The amount and oxidizing strength of component (D) used should be sufficient to cause a change in the color and/or an increase in the ultraviolet adsorption at some wavelength in the range of 160–450 nanometers (hereinafter abbreviated "nm") of a precursor solution containing only water, components (A), (B), and (C), and any possible reaction products among these constituents, after component (D) is added to the precursor mixture solution. Ordinary ambient air or any other source of gaseous oxygen is suitable as the oxidizing agent, but for speed of preparation, convenience, and facile control of the process, soluble compounds including a peroxide and/or superoxide moiety are preferred, with peroxide more preferred and hydrogen peroxide most preferred, as at least part of component (D). The ratio of the molar concentration of peroxide moieties present in the solution before reaction to the molar concentration of cobalt atoms present in the solution preferably is, with increasing preference in the order given, at least 0.05, 0.10, 0.20, 0.30, 0.40, 0.45, 0.50, 0.55, 0.60, 0.65, 0.68, 0.71, or 0.73 and independently preferably is, with increasing preference in the order given, not more than 10, 7, 5, 3, 2, 1.5, 1.0, 0.95, 0.90, 0.85, 0.80, 0.77, or 0.74. However, even when peroxide is used in preparing a composition according to the invention, it is preferable to keep the composition well aerated during use, by employing (i) a spray to contact the solution with the metal to be treated, (ii) a separate spray treater for aeration purposes in a process line through which the composition according to the invention is circulated during use, and/or (iii) sparging with air and/or oxygen gas in a container for the composition in such a process line, which container conveniently may be the immersion tank if immersion processing is used.

The presence, particularly from the beginning of reaction, of nitrate ions in the mixture reacted to make a composition according to this invention is generally preferred, because it has been observed that more nearly uniform coatings on aluminum are achieved by a process according to the invention in such cases. Accordingly, the ratio of the molar concentration of nitrate ions before reaction to the molar concentration of cobalt atoms in the aqueous compositions reacted to make compositions according to this invention preferably is, with increasing preference in the order given, not less than 0.05, 0.1, 0.2, 0.4, 0.6, 0.8, 1.0, 1.2, 1.4, 1.6, 1.8, 1.9, or 1.95 and independently preferably is, with increasing preference in the order given, not more than 20, 15, 10, 5, 4, 3.5, 3.0, 2.8, 2.6, 2.4, 2.2, 2.1, or 2.05.

The pH value of working compositions according to this invention preferably is, with increasing preference in the order given, at least 3, 4, 4.5, 5.0, 5.5, 6.0, 6.2, 6.3, 6.4, 6.5, 6.6, 6.7, or 6.8 and independently preferably is, with increasing preference in the order given, not more than 10, 9, 8.5, 8.2, 8.0, 7.9, 7.8, 7.7, 7.6, 7.5, 7.4, 7.3, or 7.2. Values of pH within these preferred ranges will generally result from using the preferred components noted above in preparing the compositions according to the invention, but the pH value may be adjusted as needed by minor additions of other acidic or basic components as generally known in the art. Values of pH higher than the preferred upper limits given above often result in rapid formation of cobalt containing precipitates, thereby making the compositions unfit for their normal use, while pH values below the preferred lower limits given above are likely to destabilize cobalt(III) sufficiently to impair the desired functioning of the compositions.

In preparing the compositions according to the invention, components (A) and (B) are preferably mixed together in aqueous solution at first in the absence of other constituents, except for the counterions of components (A) and (B), and component (C) then added to this mixture. Only after components (A), (B), and (C) have been well mixed in solution should any component (D) (except for the air in equilibrium with the aqueous solution) be added. Although the temperature during mixing is not believed to be critical, so that any temperature between the freezing and boiling points of the solution may be used, all these additions are most preferably made while the solution is at approximately normal ambient temperature, i.e., 20–25° C.

A preferred partial concentrate composition according to the invention is an aqueous liquid composition that consists essentially of, or more preferably consists of, water, cobalt (II) cations, carboxylate anions, and any additional counterions needed for the latter two constituents. These partial concentrates preferably contain, with increasing preference in the order given, at least 1, 2.0, 2.5, 3.0, 3.3. 3.5, or 3.7% of cobalt(II) cations and independently preferably have molar ratios of carboxylate and cobalt(II) within the same preferred ranges as are indicated above for working compositions according to the invention. More preferably, the only essential constituents of these concentrates are water, cobalt nitrate, and alkaline earth metal, most preferably magnesium, acetate.

Ordinarily, before treatment with a composition according to this invention, a metal substrate surface preferably should be cleaned and, if the substrate is one of the metals such as aluminum and magnesium that are prone to spontaneous formation of thick oxide layers on their surfaces, deoxidized by processes known per se in the prior art, or other suitable processes. Preferred examples may be found in the working examples below.

Compositions according to the invention can be used in processes according to the invention over a substantial range of temperatures, with formation of protective coatings generally at least slightly faster at higher temperatures within the range. As a generalization, the temperature during contact between a composition according to the invention and a metal substrate to be treated preferably is, with increasing preference in the order given, at least 20, 30, 35, 40, 43, 45, 47, or 49° C. and independently preferably is, with increasing preference in the order given, not more than 90, 85, 80, 75, 72, 69, 67, 65, 63, 62, 61, or 60° C.

Contact between a composition according to the invention and the metal substrate being treated in a process according to the invention can be achieved by any convenient method or combination of methods. Immersion and spraying, for example, are both capable of giving completely satisfactory results. Generally, spraying achieves desired coating weights somewhat more rapidly than immersion, perhaps because of more effective mixing of the portion of the liquid composition in close proximity to the treated surface with the bulk of the liquid composition and/or the greater opportunity for atmospheric oxygen to participate in the coating forming reaction that is provided by spraying. Whatever the actual reason, for spraying the contact time preferably is, with increasing preference in the order given, not less than 5, 10, 20, 30, 40, 50, 60, 65, 70, 75, 80, 85, or 90 seconds (hereinafter usually abbreviated "sec") and independently preferably is, with increasing preference in the order given, not more than 30, 15, 12, 10, 8, 6, 5, 4, 3, 2.5, 2.2, 2.0, 1.8, 1.7, 1.6, or 1.55 minutes (hereinafter usually abbreviated "min"). For immersion, the contact time preferably is, with increasing preference in the order given, at least 0.2, 0.5, 0.8, 1.0, 1.5, 2.0, 2.5, 2.8, 3.2, 3.6, or 3.9 min and independently preferably is, with increasing preference in the order given, not more than 30, 25, 20, 15, 12, 9, 8, 7, 6, or 5 min.

After treatment by contact with a composition according to the invention, the treated metal surface now bearing a protective coating formed according to the invention preferably is rinsed with water before being dried or allowed to dry. For many applications, the protective value of the coating can be further enhanced by a "sealing" treatment with another composition. One preferred sealing treatment composition, denoted hereinafter as "Inorganic Sealing Treatment Composition #1", is an aqueous solution made by reacting 3.0 grams per liter (hereinafter usually abbreviated "g/L") of dispersed finely divided vanadium pentoxide, 10.0 g/L of sodium tungstate, and 3.0 g/L of hydrogen peroxide together in water. A second preferred sealing treatment composition, denoted hereinafter as "Organic Sealing Treatment Composition #1", contains the following ingredients: 0.9% of 45% fluozirconic acid, 1.07% of 67% nitric acid, 0.48% of 75% orthophosphoric acid, and 22.6% of an aqueous solution containing 30.4% solids of a water soluble glucamino-substituted polymer of vinyl phenol made according to the directions of column 11 lines 39–52 of U.S. Pat. No. 4,963,596, with the balance being deionized or otherwise purified water, plus any aqueous ammonia needed to adjust the pH of the sealing treatment composition to 4.0. Other suitable sealing treatment compositions are taught in U.S. Pat. No. 5,226,976.

After any sealing treatment used, the treated metal surfaces preferably are again rinsed before drying or being allowed to dry. If heat is used to accelerate drying, the temperature of the metal during drying preferably does not exceed, with increasing preference in the order given, 100, 85, 75, 66, or 60° C., in order to avoid damage to the protective quality of the coating formed by a process according to the invention After treatment according to the invention, sealing if desired, and drying, a metal substrate is well suited as a base for paint or any similar organic based protective coating, which may be applied in any manner known per se in the art.

The invention may be further appreciated by consideration of the following non-limiting working examples.

EXAMPLE 1

A working composition according to the invention was prepared as follows: 1063 grams of an aqueous solution of cobalt(II) nitrate containing 13% of cobalt and 670 grams of magnesium acetate tetrahydrate were added to about 15 liters of deionized water. After these ingredients had been thoroughly mixed at ambient temperature, aeration of the liquid mixture was begun, 131 grams of triethanolamine of 99% purity was added, and after thorough mixing of this ingredient had been accomplished, 168 grams of an aqueous solution of hydrogen peroxide containing 35% $H_2O_2$ was added. This liquid mixture was then diluted to a total volume of 30.3 liters with additional deionized water, to produce a liquid solution according to the invention that, when diluted to 10 times its initial volume with deionized water produces a test liquid with an absorbance of UV light at 362 nm wavelength, over a 1 cm long transmission path, in the range from 4 to 40%. Heating of the liquid was begun, and aeration was continued until the temperature of the mixture had been raised to 54±1° C., the selected working temperature, which was maintained during use of the composition as described below.

Rectangular panels of Type 2024-T3 aluminum alloy that were 7.6×25.4 centimeters in size were the substrates used. These substrates were subjected to the following process steps, in which all products identified by trademarks are available from the Parker Amchem Division of Henkel Corp., Madison Heights, Mich.:

1. Clean by immersion for 5 min at 60° C. in an aqueous solution containing 15 g/L of RIDOLINE® 53 silicate inhibited alkaline cleaner.
2. Rinse with hot water.
3. Deoxidize by immersion for 5 min at 21° C. in an aqueous solution containing 8.75 volume % of DEOXALUME® 2200 Deoxidizer Make up concentrate and 10.0 volume % of DEOXALUME® 2200 Deoxidizer Additive Supplemental Concentrate.
4. Rinse with cold water.
5. Immerse in the working composition according to the invention described next above at the temperature also noted above for 4 min.
6. Remove from contact with the working composition according to the invention and rinse with cold water.
7. Immerse for 5 min at 60±1° C. in Inorganic Sealing Treatment Composition #1 as described above.
8. Remove from contact with the Inorganic Sealing Treatment Composition #1 and rinse with cold water.
9. Dry by blowing with air and/or in an oven at 32 to 66° C.
10. For some of the panels, coat successively with Crown Metro™ 10-P4-2 Epoxy Primer and 443-03-1000 Topcoat.

The panels not subjected to step 10 above were tested in standard salt spray for one week and exhibited no pits or discoloration. The panels subjected to step 10 were scribed and then tested in standard salt spray. No creepage away from the scribe was detectable after 1000 hours of salt spray exposure.

EXAMPLE 2

The substrates in this example were made of aluminum casting alloy. They were subjected to the following process steps, in which all products identified by trademarks are available from the Parker Amchem Division of Henkel Corp., Madison Heights, Mich.:

1. Clean by immersion for 2 min at 60° C. in an aqueous solution containing 22 g/L of RIDOLINE® 336 alkaline cleaner.
2. Rinse with hot water.
3. Deoxidize by immersion for 2 min at 21° C. in an aqueous solution containing
2 volume % of DEOXALUME® HX-357 concentrate.
4. Rinse with cold water.
5. Spray for 2 min at 54±1° C. with the same working composition according to the invention as for Example 1.
6. Remove from contact with the working composition according to the invention and rinse with cold water.
7. Immerse for 2 min at 38±1° C. in Organic Sealing Treatment Composition #1 as described above.
8. Remove from contact with the Organic Sealing Treatment Composition #1 and rinse with cold water.
9. Dry by blowing with air and/or in an oven at 32 to 66° C.
10. Coat with epoxy powder coating.

Scribed substrates treated as described above developed no detectable creepback from the scribe after 1000 hours of standard salt spray testing. Samples immersed in water at 71±1° C. for seven consecutive days, then scratched through to the substrate, taped with adhesive tape across the scratch area, and subjected to peeling away the tape thus applied showed no loss of coating adhesion.

What is claimed is:

1. An aqueous liquid treatment composition for forming a protective coating on metal surfaces contacted therewith, said aqueous liquid treatment composition being made by reaction in aqueous solution among the following components:

(A) cobalt(II) cations;

(B) a molar concentration of carboxylate anions that is from about 0.4 to about 4.0 times the molar concentration of cobalt(II) cations;

(C) chemical species, exclusive of carboxylate anions, that form more stable coordination bonds with cobalt (III) cations than with cobalt II) cations; and (D) an oxidizing agent in an amount sufficient to produce an increase in ultraviolet light absorption at some wavelength in the range from about 160 to about 450 nanometers, compared to a precursor composition containing only components (A), (B), and (C), any counterions of components (A), (B), and (C) that are not part of components (A), (B), and (C), and products of reaction among these components, wherein the content in the composition of each of ions, ammonia, and ammonium ions is not greater than 1.0%.

2. An aqueous liquid treatment composition according to claim 1, having a pH value from about 4.5 to about 8.5 and made by reaction in aqueous solution among the following components:

(A) from about 0.008 to about 0.8 M of cobalt(II) cations;

(B) a molar concentration of carboxylate anions that is from about 0.4 to about 4.0 times the molar concentration of cobalt(II) cations;

(C) a total molar concentration of organic amines and phosphines that is from about 0.06 to about 2.0 times the molar concentration of cobalt(II) cations;

(D) a total molar concentration of peroxide compounds that is from about 0.10 to about 5 times the molar concentration of cobalt(II) cations; and (E) a molar concentration of nitrate ions that is from about 0.1 to about 10 times the molar concentration of cobalt(II) cations.

3. An aqueous liquid treatment composition according to claim 2, having a pH value from about 5.0 to about 8.0 and made by reaction in aqueous solution among the following components:

(A) from about 0.016 to about 0.6 M of cobalt(II) cations;

(B) a molar concentration of carboxylate anions that is from about 0.8 to about 3.7 times the molar concentration of cobalt(II) cations;

(C) a total molar concentration of organic arines that is from about 0.13 to about 1.75 times the molar concentration of cobalt(II) cations;

(D) a total molar concentration of peroxide that is from about 0.20 to about 3 times the molar concentration of cobalt(II) cations; and (E) a molar concentration of nitrate ions that is from about 0.4 to about 5 times the molar concentration of cobalt (II) cations.

4. An aqueous liquid treatment composition according to claim 3, having a pH value from about 5.5 to about 7.9 and made by reaction in aqueous solution among the following components:

(A) from about 0.016 to about 0.6 M of cobalt(II) cations;

(B) a molar concentration of carboxylate anions that is from about 1.2 to about 3.4 times the molar concentration of cobalt(II) cations;

(C) a total molar concentration of organic amines that is from about 0.20 to about 1.50 times the molar concentration of cobalt(II) cations;

(D) a total molar concentration of peroxide that is from about 0.30 to about 2 times the molar concentration of cobalt(II) cations; and (E) a molar concentration of nitrate ions that is from about 0.6 to about 3.5 times the molar concentration of cobalt(II) cations.

5. An aqueous liquid treatment composition according to claim 4, having a pH value from about 6.0 to about 7.8 and made by reaction in aqueous solution among the following components:

(A) from about 0.032 to about 0.4 M of cobalt(II) cations;

(B) a molar concentration of carboxylate anions that is from about 1.5 to about 3.1 times the molar concentration of cobalt(II) cations;

(C) a total molar concentration of organic amines that is from about 0.24 to about 1.00 times the molar concentration of cobalt(II) cations;

(D) a total molar concentration of peroxide that is from about 0.40 to about 1.5 times the molar concentration of cobalt(II) cations; and (E) a molar concentration of nitrate ions that is from about 0.8 to about 3.0 times the molar concentration of cobalt(II) cations.

6. An aqueous liquid treatment composition according to claim 5, having a pH value from about 6.2 to about 7.7 and made by reaction in aqueous solution among the following components:

(A) from about 0.045 to about 0.2 M of cobalt(II) cations;

(B) a molar concentration of carboxylate anions that is from about 1.8 to about 3.0 times the molar concentration of cobalt(II) cations;

(C) a total molar concentration of organic amines that is from about 0.28 to about 0.75 times the molar concentration of cobalt(II) cations;

(D) a total molar concentration of peroxide that is from about 0.50 to about 1.0 times the molar concentration of cobalt(II) cations; and (E) a molar concentration of nitrate ions that is from about 1.0 to about 2.8 times the molar concentration of cobalt(II) cations.

7. An aqueous liquid treatment composition according to claim 6, having a pH value from about 6.4 to about 7.6 and made by reaction in aqueous solution among the following components:

(A) from about 0.055 to about 0.14 M of cobalt(II) cations;

(B) a molar concentration of carboxylate anions that is from about 2.2 to about 2.9 times the molar concentration of cobalt(II) cations;

(C) a total molar concentration of organic amines that is from about 0.32 to about 0.60 times the molar concentration of cobalt(II) cations;

(D) a total molar concentration of peroxide that is from about 0.65 to about 0.90 times the molar concentration of cobalt(II) cations; and (E) a molar concentration of nitrate ions that is from about 1.2 to about 2.4 times the molar concentration of cobalt(II) cations.

8. An aqueous liquid treatment composition according to claim 7, having a pH value from about 6.5 to about 7.4 and made by reaction in aqueous solution among the following components:

(A) from about 0.063 to about 0.14 M of cobalt(II) cations;

(B) a molar concentration of carboxylate anions that is from about 2.3 to about 2.8 times the molar concentration of cobalt(II) cations;

(C) a total molar concentration of organic alkoxyl amines that is from about 0.34 to about 0.45 times the molar concentration of cobalt(II) cations;

(D) a total molar concentration of peroxide that is from about 0.68 to about 0.80 times the molar concentration of cobalt(II) cations; and (E) a molar concentration of nitrate ions that is from about 1.6 to about 2.2 times the molar concentration of cobalt(II) cations.

9. An aqueous liquid treatment composition according to claim 8, having a pH value from about 6.8 to about 7.2 and made by reaction in aqueous solution among the following components:

(A) from about 0.074 to about 0.80 M of cobalt(II) cations;

(B) a molar concentration of acetate anions that is from about 2.5 to about 2.8 times the molar concentration of cobalt(II) cations;

(C) a molar concentration of triethanol amine that is from about 0.35 to about 0.41 times the molar concentration of cobalt(II) cations;

(D) a molar concentration of hydrogen peroxide that is from about 0.71 to about 0.77 times the molar concentration of cobalt(II) cations; and (E) a molar concentration of nitrate ions that is from about 1.8 to about 2.2 times the molar concentration of cobalt(II) cations.

10. A process of treating an aluminum or aluminum alloy surface, so as to form a cobalt containing protective layer thereon, with an aqueous liquid treatment composition according to claim 9 at a temperature from about 49 to about 60° C. either by spraying for from about 90 sec to about 1.55 minutes or by immersion for from 3.9 to 5 min.

11. A process of treating an aluminum or aluminum alloy surface, so as to form a cobalt containing protective layer thereon, with an aqueous liquid treatment composition according to claim 8 at a temperature from about 45 to about 65° C. either by spraying for from about 1.0 to about 2.0 minutes or by immersion for from 2.8 to 6 min.

12. A process of treating an aluminum or aluminum alloy surface, so as to form a cobalt containing protective layer thereon, with an aqueous liquid treatment composition according to claim 7 at a temperature from about 40 to about 75° C. either by spraying for from about 30 sec to about 3 minutes or by immersion for from 2.0 to 8 min.

13. A process of treating a metal surface, so as to form a cobalt containing protective layer thereon, with an aqueous liquid treatment composition according to claim 6 at a temperature from about 35 to about 80° C. either by spraying for from about 10 sec to about 5 minutes or by immersion for from 1.0 to 12 min.

14. A process for treating an aluminum or alloy surface, so as to form a cobalt containing protective layer thereon, comprising contacting the aqueous liquid treatment composition of claim 5 to an aluminum or alloy surface.

15. A process for treating an aluminum or alloy surface, so as to form a cobalt containing protective layer thereon, comprising contacting the aqueous liquid treatment composition of claim 4 to an aluminum or alloy surface.

16. A process for treating an aluminum or alloy surface, so as to form a cobalt containing protective layer thereon, comprising contacting the aqueous liquid treatment composition of claim 3 to an aluminum or alloy surface.

17. A process for treating an aluminum or alloy surface, so as to form a cobalt containing protective layer thereon, comprising contacting the aqueous liquid treatment composition of claim 2 to an aluminum or alloy surface.

18. A process for treating an aluminum or alloy surface, so as to form a cobalt containing protective layer thereon, comprising contacting the aqueous liquid treatment composition of claim 1 to an aluminum or alloy surface.

19. An aqueous liquid concentrate composition of matter suitable for preparing a composition according to claim 1, said concentrate composition consisting essentially of water, cobalt(II) ions, carboxylate ions, and nitrate ions, and, optionally, alkaline earth metal cations, with a molar ratio of acetate to cobalt(II) in the range from about 1.2 to about 3.0 and a total concentration of cobalt(II) cations of at least 1%.

20. An aqueous liquid concentrate composition according to claim 19, consisiting essentially of water, an amount of cobalt(II) nitrate that is stoichiometrically equivalent to at least about 3.3% cobalt, and an amount of alkaline earth acetate such that the molar ratio of acetate to cobalt(II) in the concentrate composition is from about 2.4 to about 2.8.

* * * * *